US006460394B2

(12) United States Patent
Hidaka et al.

(10) Patent No.: US 6,460,394 B2
(45) Date of Patent: Oct. 8, 2002

(54) METHOD OF MANUFACTURING HEAT EXCHANGING FIN AND DIE SET FOR MANUFACTURING THE SAME

(75) Inventors: Shotaro Hidaka; Mamoru Yamada, both of Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/816,320

(22) Filed: Mar. 26, 2001

(65) Prior Publication Data

US 2002/0005057 A1 Jan. 17, 2002

(30) Foreign Application Priority Data

Jul. 13, 2000 (JP) ..... 2000-212543

(51) Int. Cl.[7] ..... B21D 28/32

(52) U.S. Cl. ..... 72/335; 72/355.6; 72/379.2; 29/890.043

(58) Field of Search ..... 72/355.6, 355.4, 72/379.2, 414, 345, 335, 333; 29/890.038, 890.043, 890.045, 890.04

(56) References Cited

U.S. PATENT DOCUMENTS 1,642,166 A * 9/1927 McCaffrey ..... 72/379.2
3,575,122 A * 4/1971 Brossart et al. ..... 72/379.2
4,031,836 A * 6/1977 Grise et al. ..... 413/12
4,373,369 A * 2/1983 Schey ..... 72/355.4
4,442,693 A * 4/1984 Walter et al. ..... 72/355.6
5,016,463 A * 5/1991 Johansson et al. ..... 72/348
5,174,145 A * 12/1992 Tsuzuki ..... 72/379.2
5,237,849 A * 8/1993 Miyazawa ..... 29/890.047
5,487,295 A * 1/1996 Diekhoff et al. ..... 72/379.4
5,950,483 A * 9/1999 Schneider et al. ..... 72/414

* cited by examiner

*Primary Examiner*—Daniel C. Crane
(74) *Attorney, Agent, or Firm*—Birch, Stewart, Kolasch & Birch, LLP

(57) ABSTRACT

The method of manufacturing a heat exchanging fin is able to restrict forming wrinkles and ring marks in the heat exchanging fin. The method comprises the steps of: forming dome sections having diameters greater than the diameters of collared-through-holes and which are projected from one side face of a thin plate, and a plurality of circular recesses having diameters greater than of the dome sections, each of which encloses one of the dome sections, the circular recesses being depressed toward the opposite face of the thin plate; forming the dome sections and the recesses into truncated cone-shaped sections in a plurality of steps; forming a through-hole in each of the truncated cone-shaped sections; forming edges of the through-holes into collars; and forming a flange at a front end of each of the collars.

4 Claims, 6 Drawing Sheets

METHOD OF MANUFACTURING HEAT EXCHANGING FIN AND DIE SET FOR MANUFACTURING THE SAME

BACKGROUND OF THE INVENTION

The present invention relates to a method of manufacturing a heat exchanging fin and a die set for manufacturing the heat exchanging fin.

As shown in FIG. 7, the heat exchanging fin 8, which is employed in a heat exchanger of, for example, an air conditioner, comprises; a plate section 9*a* made of aluminum, etc.; and collared-through-holes 17 through which heat exchanging tubes (not shown) are pierced.

The heat exchanging fin 8 is formed by a so-called drawing manner. The drawing manner comprising the steps of: drawing a thin aluminum plate to form a plurality of cone-shaped sections; forming the cone-shaped sections into truncated cone-shaped sections, in a plurality of steps, with gradually reducing diameter of the cone-shaped sections; forming through-holes in the truncated cone-shaped sections having prescribed height so as to form into collars 7; and forming flanges 8 at front ends of the collars 7.

The heat exchanging fin 8 formed by the drawing manner is shown in FIGS. 8A and 8B.

Firstly, the cone-shaped sections 1 are formed in a thin plate 9 drawing punches (not shown). Then, the cone-shaped sections 1 are firstly shaped, by first forming punches, into truncated cone-shaped sections 2 with reducing diameter.

The truncated cone-shaped sections 2 are secondly shaped, by second forming punches, into truncated cone-shaped sections 3, whose diameter is shorter than that of the truncated cone-shaped sections 2.

The truncated cone-shaped sections 3 are thirdly shaped, by third forming punches, into truncated cone-shaped sections 4, whose diameter is shorter than that of the truncated cone-shaped sections 3.

The truncated cone-shaped sections 4 have enough height for the collars 7 to be formed.

Further, through-holes 5 are respectively bored, by pierce punches (not shown), in the truncated cone-shaped sections 4, then the collars 7 are formed by burring punches (not shown). Finally, the flanges 8 are formed at the front ends of the collars 7 by flaring means.

In the drawing manner, in which the cone-shaped sections 1 are formed in the thin plate 9 by drawing, parts of the material around the cone-shaped sections 1, which constitute the thin plate 9, are drawn toward the cone-shaped sections 1 while drawing the thin plate 9, so that thickness of the thin plate is not fixed between the cone-shaped sections 1. Therefore, there are formed wrinkles 32 between the adjacent cone-shaped sections 1, and the wrinkles 32 are left after the collared-through-holes 17 are completely formed, so that the heat exchanging fin 8 has a poor appearance.

In the case of forming low collars, dome-shaped sections may be formed, by bulging, in the thin plate instead of forming the cone-shaped sections so as to remove the wrinkles.

In the bulging step, thickness of projected sections, which are formed by punches, are made thinner so as to form the collars. Unlike the drawing manner, in which the parts of the material around the cone-shaped sections are drawn, high collars cannot be formed. But drawing the parts of the material can be reduced, so that the thickness of the thin plate can be fixed between the dome-shaped sections and the wrinkles between the adjacent dome-shaped sections can be reduced.

However, forming the wrinkles 32 cannot be perfectly prevented by bulging. Thus, heat exchanging fins having no wrinkles 32 cannot be manufactured.

A plurality of columns of the collared-through-holes 17, which are arranged in a direction "B" in FIG. 8A, are simultaneously formed in the thin plate 9 in one press action of a die set; one or a plurality of rows of the collared-through-holes 17, which are arranged in a direction "A" in FIG. 8A, are simultaneously formed in the thin plate 9 in one press action of the die set. Positioning accuracy of the collared-through-holes 17, which are simultaneously formed, depends on manufacturing accuracy of the die set. If the wrinkles 32 are formed between the collared-through-holes 17, they are extended in following steps: a flattening step, a cutting step. By extending the wrinkles 32, pitches between the collared-through-holes 17 are partially changed.

The thin plate 9, in which the collared-through-holes 17 have been formed, is cut to leave the heat exchanging fin 8 including one or a plurality of lines of the collared-through-holes 17 by a cutter blade (not shown). At that time, if there are wrinkles 32 between the collared-through-holes 17, the cutter blade extends the wrinkles 32, so that the pitch of the collared-through-holes 17, between which the wrinkles 32 are formed, is different from the pitch of the collared-through-holes 17, between which no wrinkles 32 are formed.

The fin plate 9 is intermittently sent in the direction "B" and cut so as to leave the heat exchanging fin 8. In the cutting step, cutting lines are sometimes partially overlapped. If the wrinkles 32 are formed in the thin plate 9, the wrinkles 32 are extended by the cutting blade, so that the overlapped cutting lines are mutually shifted. By the shift of the cutting lines, flashes are formed in an edge of the heat exchanging fin 8, which corresponds to the overlapped portion.

In each of the steps of shaping the truncated cone-shaped sections, the diameters of the cone-shaped sections or the truncated cone-shaped sections, which have been formed in the prior step, are reduced. If the rate of diameter reduction in each successive step is great, parts of the cone-shaped sections or the truncated cone-shaped sections, which are located outside of the forming dies whose diameter are shorter than that of the cone-shaped sections or the truncated cone-shaped sections to be shaped, are pressed between the forming dies and a lifter when the die set is closed.

The pressed parts are left as circular grooves (ring marks) 30 enclosing the collars 7.

The ring marks 30 are deformed and hardened during the shaping steps, so they cannot be removed in the following steps and adversely influence the shapes of heat exchanging fins 8. The number of the ring marks 30 of each collar 7 is defined by the number of the shaping steps.

SUMMARY OF THE INVENTION

An object of the present invention is to provide a method of manufuring a heat exchanging fin, in which forming the wrinkles and the ring marks can be restricted.

Another object of the present invention is to provide a die set for executing the method of the present invention.

In the present invention the method of manufacturing a heat exchanging fin having a plurality of collared-through-holes, comprises the steps of:

forming a plurality of dome sections, whose diameter is greater than inner diameter of the collared-through-holes and which are projected from one side face of a thin plate, and a plurality of circular recesses, whose diameter is greater than that of the dome sections and each of which encloses each of the dome sections and are depressed toward the other face of the thin plate;

forming the dome sections and the recesses into truncated cone-shaped sections having prescribed height in a plurality of steps;

forming a through-hole in each of the truncated cone-shaped sections;

forming edges of the through-holes into collars; and forming a flange at a front end of each of the collars.

In the method of the present invention, the dome sections and the circular recesses are formed by bulging, so the circular recesses prevent the material constituting the thin plate from being drawn toward the dome sections. With this prevention, no wrinkles are formed between the dome sections, and the thickness of the thin plate can be uniform between the dome sections. Further, the dome sections and the circular recesses are gradually formed into the truncated cone-shaped section in a plurality of steps, so that higher collars can be easily formed.

In the method, the diameter of the dome sections may be nearly equal to that of the truncated cone-shaped sections, which is formed in the first step. In this case, the parts of the cone-shaped sections or the truncated cone-shaped sections, which are located outside of the forming dies whose diameter are shorter than that of the cone-shaped sections or the truncated cone-shaped sections to be shaped, are not pressed between the forming dies and the lifter when the die set is closed, so that no ring marks are formed.

The die set for manufacturing a heat exchanging fin, in which the heat exchanging fin is formed by the steps of forming a plurality of dome sections in a fin plate, forming the dome sections into truncated cone-shaped sections and forming the truncated cone-shaped sections into collared-through-holes, comprises:

a lower die including a bulging punch for forming the dome sections and a lifter being always biased upward by a biasing member and having a through-hole, through which the bulging punch passes when the lifter is moved downward; and an upper die relatively moving to and away from the lower die, the upper die including a bulging die, which has a die hole accommodating a front end section of the bulging punch when the upper die relatively moved to the lower die, wherein the bulging die has a projected section, which is projected, from an edge of the die hole, toward the lower die, and wherein the lifter has a concave section, which encloses the through-hole and which accommodates the projected section and forms a recess section, whose diameter is greater than that of the dome section and which encloses the dome section and is depressed in the opposite direction of the projected direction of the dome section, in the fin plate with the projected section when the upper die relatively moves to the lower die.

In the die set of the present invention, the dome sections and the circular recesses are formed by the bulging die and the bulging punch, so the circular recesses prevent the material constituting the thin plate from being drawn toward the dome sections. With this action, no wrinkles are formed between the dome sections. Further, since the dome sections and the circular recesses are shaped, so that higher collars can be easily formed.

In the die set, a plurality of sets of the bulging punch and the bulging die may be provided for forming the dome sections into the truncated cone-shaped sections in a plurality of steps, and diameter of a forming punch and a forming die of the first step may be nearly equal to that of the bulging punch and the bulging die. With this structure, the parts of the cone-shaped sections or the truncated cone-shaped sections, which are located outside of the forming dies, are not pressed, so that no ring marks are formed.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

Figure 1:
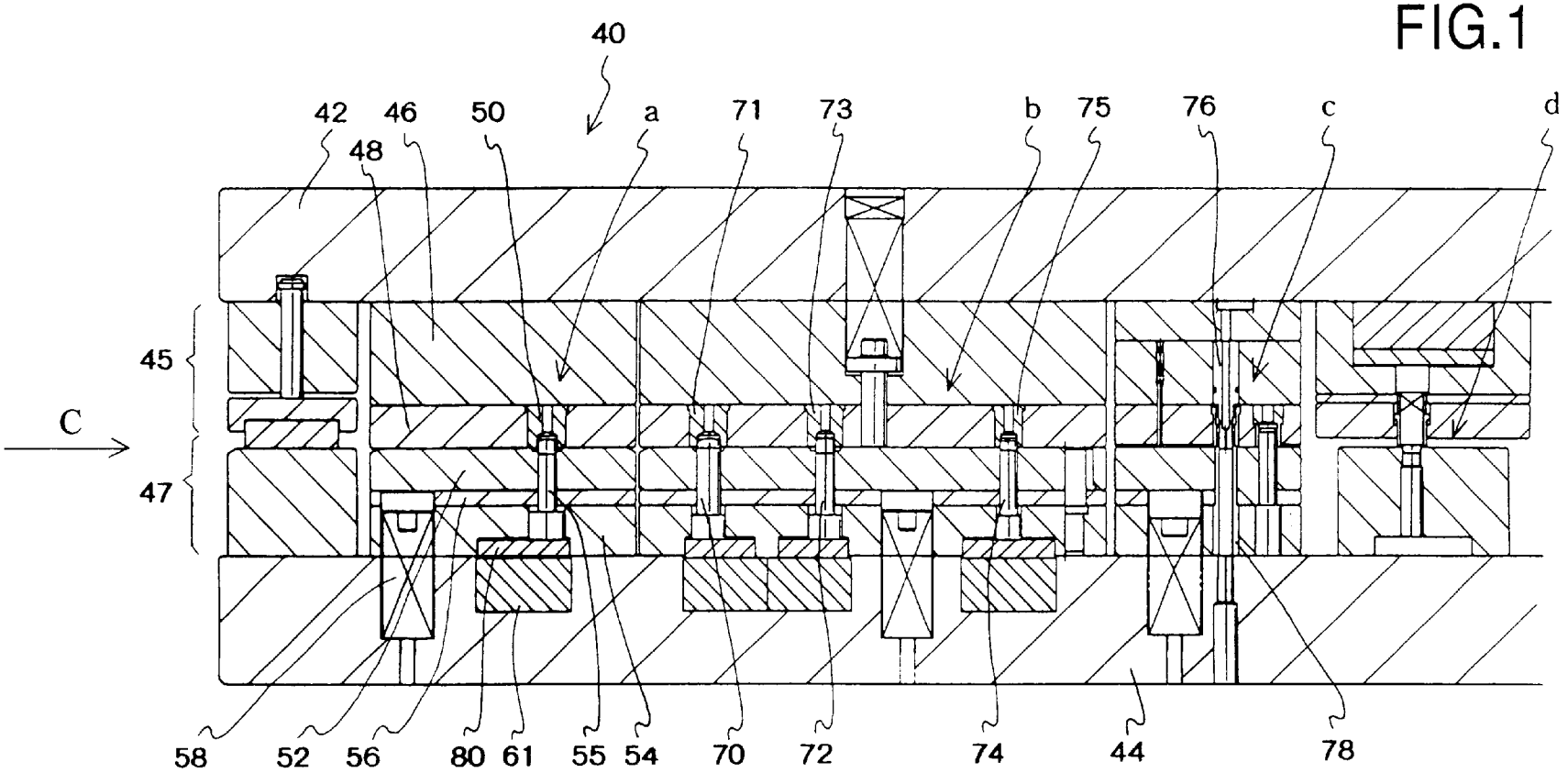
FIG. 1 is a side sectional view of the die set for manufacturing the heat exchanging fin of an embodiment of the present invention.
Figure 2:
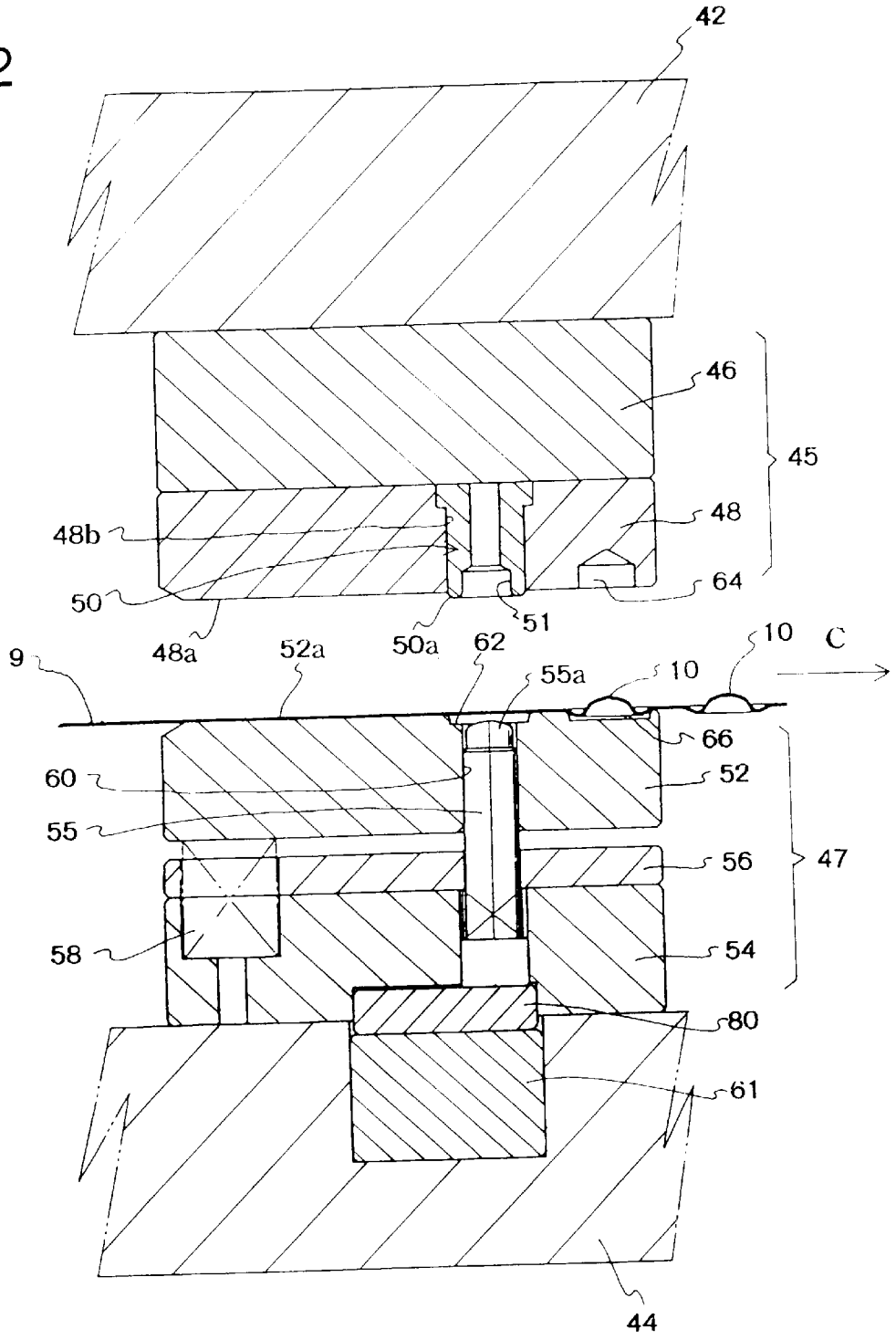
FIG. 2 is a side sectional view of a bulging step section of the die set shown in FIG. 1.

FIG. 1 is a side sectional view of the die set for manufacturing the heat exchanging fin of the present invention, and FIG. 2 is a side sectional view of a bulging step section of the die set shown in FIG. 1. Note that, structural elements explained in BACKGROUND OF THE INVENTION are assigned the same symbols and detail explanation will be omitted.

In FIG. 1, a die set 40 includes: the bulging step section "a", in which a plurality of dome sections are formed in a thin aluminum plate; a shaping step section "b", in which diameter of the dome sections are gradually reduced and formed into truncated cone-shaped section in a plurality of steps; a pierce-burring step section "c", in which through-holes are respectively formed in the truncated cone-shaped sections and edges of the through-holes are extended to form collars; and a flaring step section "d", in which flanges are respectively formed at front ends of the collars.

Further, an edge trimming step section, etc. are provided in the die set 40, but they are not shown in FIG. 1 and explanation will be omitted.

The thin plate is intermittently sent in an direction "C", with a prescribed pitch, in the die set 40. This sending action is executed with opening action of the die set 40.

The die set 40 includes: upper dies 45, which are fixed to an upper base 42; and lower dies 47, which are fixed to a lower base 44. The upper base 42 is relatively vertically moved to and away from the lower base 44.

A set of the upper die 45 and the lower die 47 are provided in each of the step sections "a"–"d", and punches and dies for the step sections are selectively attached to the upper dies 45 and the lower dies 47.

A plurality of the same punches and dies are arranged, in the direction perpendicular to the surface of the drawing of FIG. 1, in each of the step section "a"–"d".

In the bulging step section "a", bulging punches 50 and bulging dies 55 are provided. The shaping step section "b", which includes a plurality of steps, follows the bulging step section "a". The shaping step section "b" includes a first forming punch 70, a first forming die 71, a second forming punch 72, a second forming die 73, a third forming punch 74 and a third forming die 75. Namely, three steps of forming or shaping are executed in the shaping step section "b".

Diameter of a front end of the first forming punch 70 is slightly shorter than that of the bulging punch 55. Inner diameter of the first forming die 71 is slightly shorter than that of the bulging die 50 as well.

Diameter of a front end of the second forming punch 72 is properly shorter than that of the first forming punch 70; inner diameter of the second forming die 73 is properly shorter than that of the first forming die 71.

Diameter of a front end of the third forming punch 74 is properly shorter than that of the second forming punch 72; inner diameter of the third forming die 75 is properly shorter than that of the first forming die 73 as well.

The rate of the diameter reduction from one step of forming or shaping to the next can be expressed by the formula DR=D2/D1

Note: D1 is the diameter of the punch and die of a foregoing step; and

D2 is the diameter of the punch and die of a following step.

The proper rate of diameter reduction DR is 0.8 or more.

Next, the bulging step section "a" will be explained with reference to FIG. 2.

The upper die 45 includes a spacer 46, which is fixed to a bottom face of the upper base 42, and a die plate 48, which is fixed to a bottom face of the spacer 46.

Figure 5:
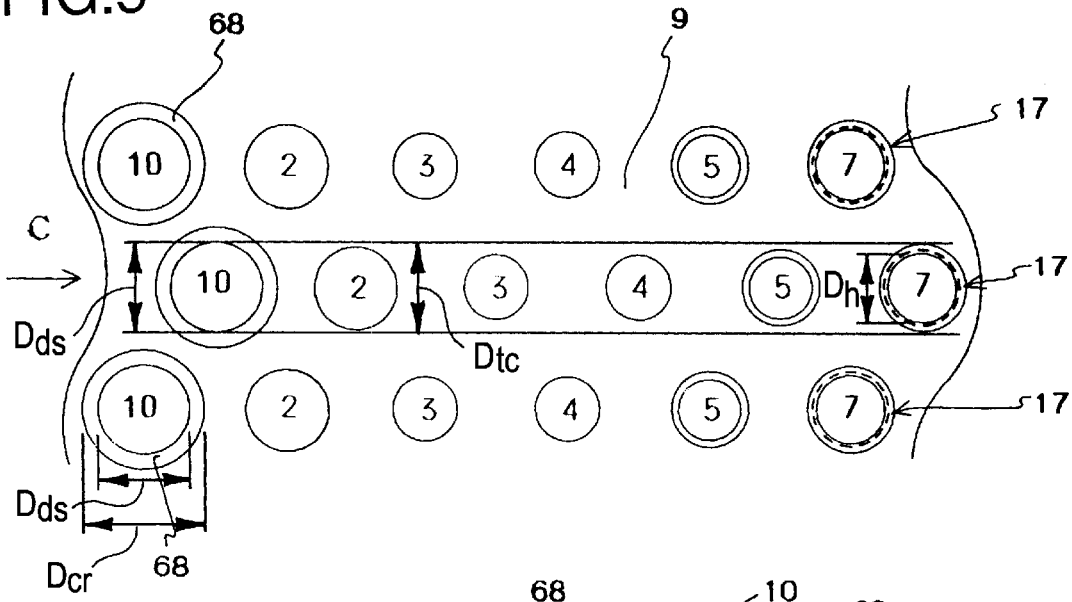
FIG. 5 is a plan view of a thin plate, in which collared-through-holes are formed.
Figure 6A:
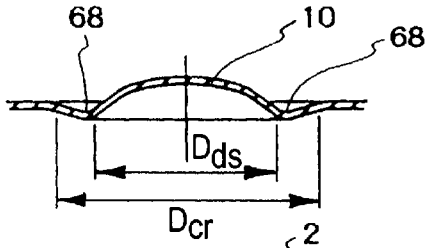
FIG. 6A is a sectional view of a dome section.
Figure 6B:
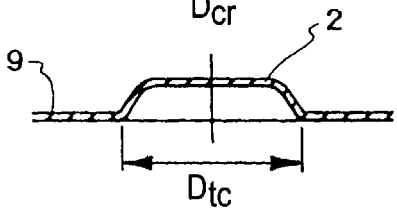
FIG. 6B is a sectional view of a truncated cone-shaped section, which is firstly shaped.
Figure 6C:
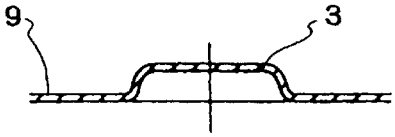
FIG. 6C is a sectional view of the truncated cone-shaped section, which is secondly shaped.

The bulging dies 50, which form the dome sections 10 with the bulging punches 55 of the lower die 47 when the die set 40 is closed, are attached to the die plate 48. The dome sections 10 so formed have diameters $D_{ds}$ as shown in FIGS. 5 and 6A.

The bulging dies 50 are fitted in holes 48*b* of the die plate 48. The bulging dies 50 respectively have die holes 51, into which front end sections 55*a* of the bulging punches 55 can be inserted.

Lower end sections 50*a* of the bulging dies 50 are downwardly projected from the bottom face 48*a* of the die plate 48.

The lower die 47 includes a punch plate 54, which is fixed on an upper face of the lower base 44 and in which the bulging punches 55 are inserted and fixed, a punch-press plate 56, which is fixed on an upper face of the punch plate 54, and a lifter 52, which is always upwardly biased by a spring 58 and which is downwardly moved against the elasticity of the spring 58 when the die set 40 is closed and the upper die 45 presses the lifter.

Through-holes 60 are formed in the lifter 52, and the front end sections 55*a* of the bulging punches 55 can be projected therefrom.

Height adjusters 61 and 80 are provided between the lower base 44 and the punch plate 48 so as to adjust height of the bulging punches 55. The bulging punches 55 are provided above them.

An upper face of the height adjuster 61 and a bottom face of the height adjuster 80 are slanting surfaces (not shown), and the slanting surfaces slidably contact each other. With this structure, the height of the bulging punches 55 can be changed by relatively sliding one of the height adjusters 61 and 80 in the direction perpendicular to the surface of the drawing of FIG. 2.

Circular step sections 62 are formed in the upper face 52*a* of the lifter 52, and they respectively enclose edges of the through-holes 60, in which the bulging punches 55 are inserted. Depth of the circular step sections 62 are designed to accommodate the projected sections 50*a* of the bulging dies 50 and allow the bottom face 48*a* of the die plate 48 to contact the upper face 52*a* of the lifter 52 when the die set 40 is closed.

Holes 64 are formed in the die plate 48 and capable of accommodating the dome section 10 therein. A distance between the bulging die 50 and the hole 64 is equal to one pitch of sending the thin plate 9 in the direction Cavities 66, in which circular recesses 68 of the thin plate 9 can be accommodated, are formed in the upper face 52*a* of the lifter 52, and they are arranged to respectively face the holes 64.

Next, the method of manufacturing the heat exchanging fin with the die set of the present embodiment will be explained.

Figure 3:
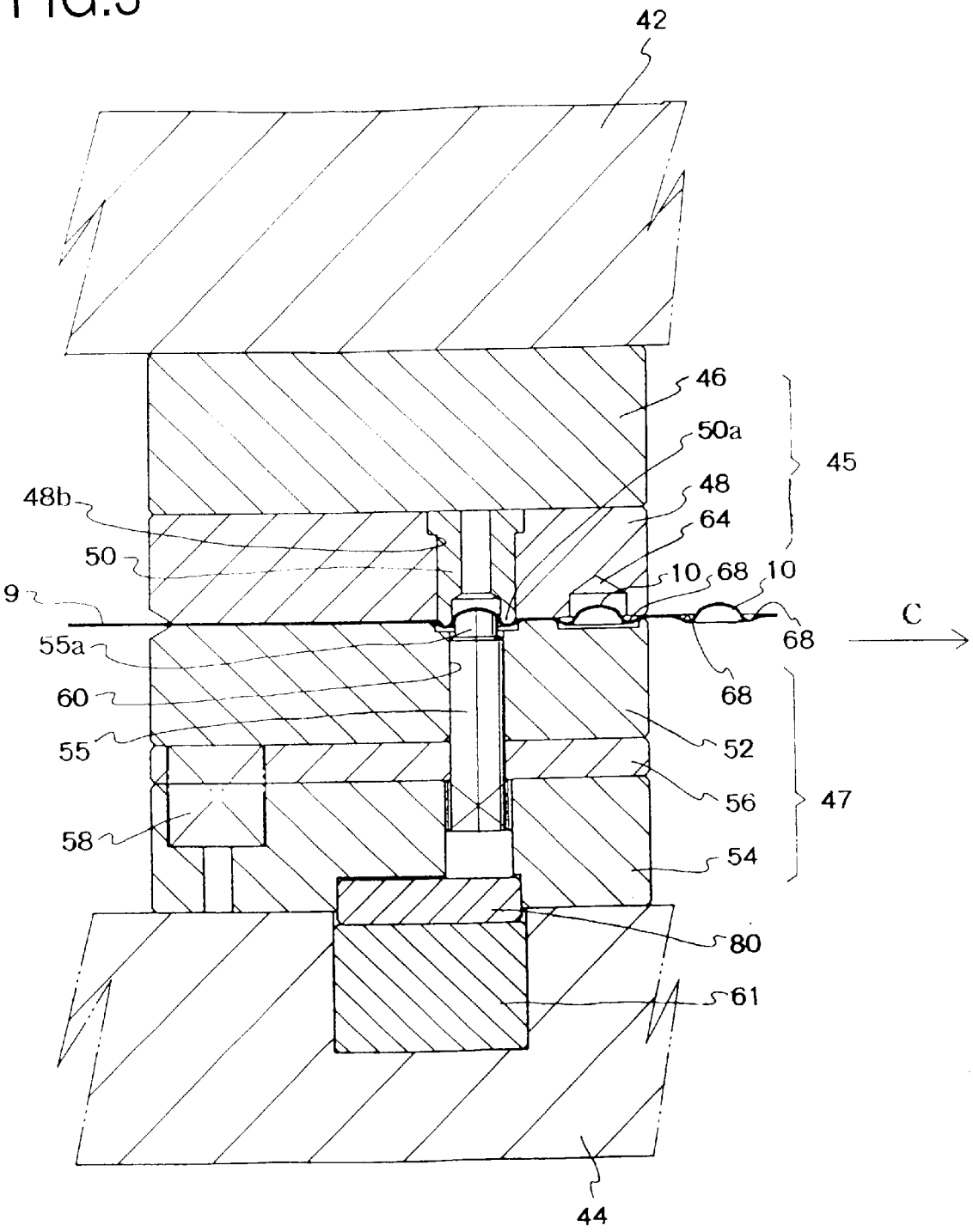
FIG. 3 is a side sectional view of a closing state of the bulging step section shown in FIG. 2.
Figure 4:
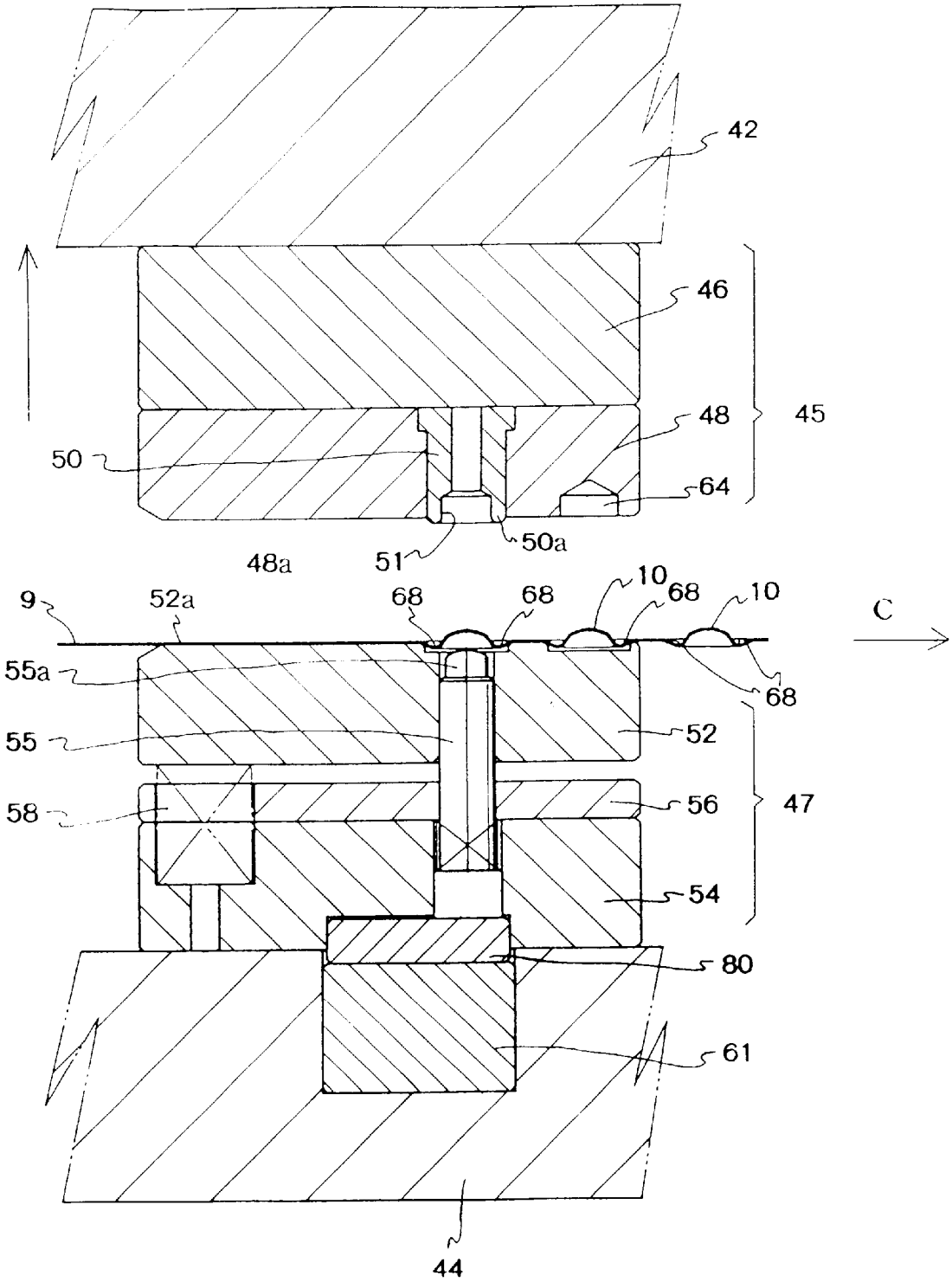
FIG. 4 is a side sectional view of a opening state of the bulging step section shown in FIG. 3.

FIG. 3 shows the state of closing the die set shown in FIG. 2; FIG. 4 shows the state of opening the die set shown in FIG. 3.

By downwardly moving the upper base 42 together with the upper die 45, the projected sections 50*a* of the bulging dies 50, which are downwardly projected from the die plate 48, contact the thin plate 9. Then the projected sections 50*a* of the bulging dies 50 go into the circular step sections 62 of the lifter 52, so that the circular recesses 68, which look like circular grooves and whose bottoms are projected from a bottom face of the thin plate 9, are formed in the thin plate 9. The circular recesses so formed have diameters $D_{cr}$ as shown in FIGS. 5 and 6A.

Immediately after the projected sections 50*a* contact the thin plate 9, the bottom face 48*a* of the die plate 48 contacts the upper face 52*a* of the lifter 52, the upper die 45 downwardly moves the lifter 52 against the elasticity of the spring 58, and the front end sections 55*a* of the bulging punches 55 contact the thin plate 9.

Further, the lifter 52 is moved downward, so that the bulging punches 55 are gradually projected from the through-holes 60 and form the dome sections 10 in the thin plate 9 with the bulging dies 50.

When the die plate 48 presses and moves the lifter 52 to a lower dead point of a pressing stroke, the closing action of the die set 40 completes. At that time, as shown in FIG. 3, the dome sections 10 are formed in the thin plate 9 by the bulging punches 55 and the bulging dies 50. Bottom diameters $D_{ds}$ of the dome sections 10 are nearly equal to diameters of the truncated cone-shaped sections formed in the first step, but are slightly greater than diameters $D_h$ of the collars 7 to be formed later on.

Figure 6D:
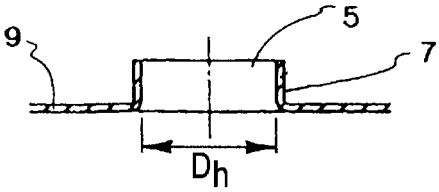
FIG. 6D is a sectional view of a collared-through-hole, which is pierced and burred.
Figure 6E:
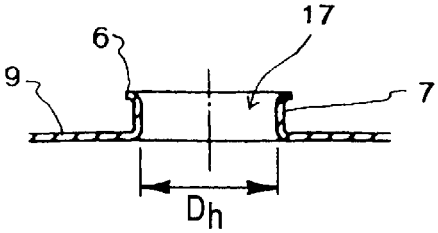
FIG. 6E is a sectional view of the collared-through-hole, in which a flange is formed.
Figure 7:
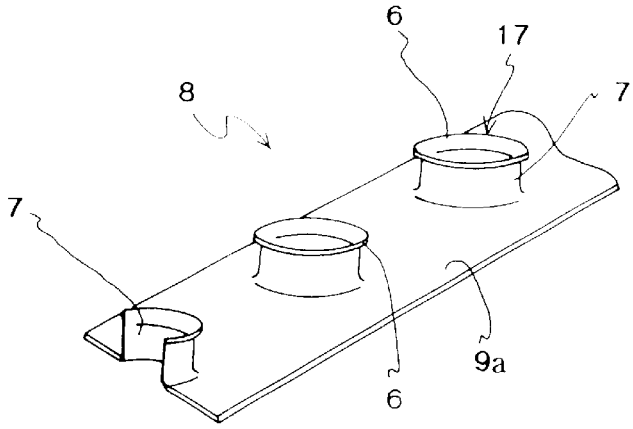
FIG. 7 is a perspective view of the heat exchanging fin.
Figure 8A:
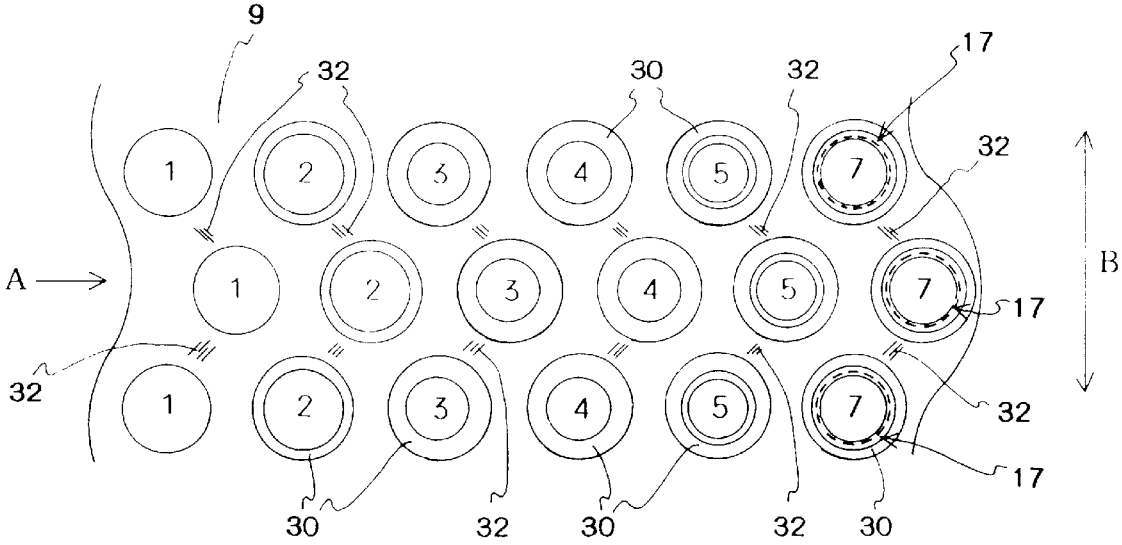
FIG.8A PRIOR ART
FIG. 8A is a plan view of the thin plate, in which the collared-through-holes are formed by the conventional method.
Figure 8B:
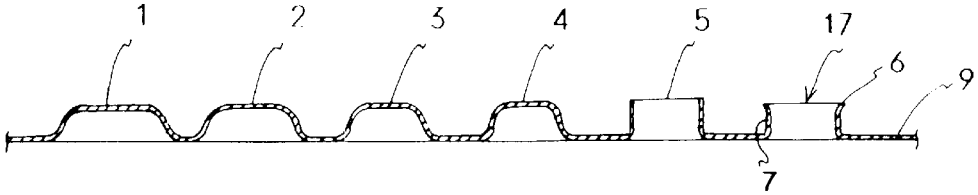
FIG.8B PRIOR ART
FIG. 8B is a sectional view of the thin plate, in which the collared-through-holes are formed by the conventional method.

This is clearly shown in FIG. 5 and can be seen by comparing FIGS. 6A, 6D and 6E. The circular recesses 68 respectively enclose the dome sections 10. The circular recesses 68, have diameters $D_{cr}$ greater than diameters $D_{ds}$ of the dome sections 10, and the circular recesses are depressed toward the bottom face of the thin plate 9. With this structure, the circular recesses 68 prevent the material constituting the thin plate 9 from being drawn toward the dome sections 10. With this action, no wrinkles are formed between the adjacent dome sections 10, and the thickness of the thin plate 9 can be uniform between the dome sections 10.

When the die set 40 is closed, the dome sections 10 and the circular recesses 68 are respectively accommodated in the holes 64 of the die plate 48 and the cavities 66 of the lifter 52, so they are not deformed during the closing action of the die set 40. Cavities 66 have diameters $D_c$ as can be seen in FIG. 2.

Upon completing the closing action of the die set 40, the upper base 42 and the upper die 45 are moved upward to open the die set 40 as shown in FIG. 4. After the die set 40 is opened, the thin plate 9 is sent one pitch in the direction "C" so as to send the dome sections 10 to the shaping step section "b".

Next, actions for forming the dome sections 10 into the collared-through-holes 17 will be explained with reference to FIGS. 6A–6E.

The dome sections 10, which are formed by the dies shown in FIGS. 2–4, are sent for the first step of the shaping step section "b", and the dome sections 10 are firstly shaped by the first forming punches 70. Namely, the dome sections 10 are formed into the truncated cone-shaped sections 2.

Unlike the conventional method, the dome sections 10 and the circular recesses 68 are firstly shaped in the first step, so the height of the collars 7 can be easily made higher.

As described above, the diameter of the first forming punch 70 is nearly equal to that of the bulging punch 55 and the diameter of the first forming die is nearly equal to that of the bulging die 50. Since less of each dome section 10 is located outside of each first forming die 71, forming the mark ring can be prevented.

After completing the first step, the truncated cone-shaped sections 2 are secondly shaped by the second forming punches 72 and formed into the truncated cone-shaped sections 3, whose height is higher than that of the truncated cone-shaped sections 2.

Further, the truncated cone-shaped sections 3 are thirdly shaped by the third forming punches 74 and formed into the truncated cone-shaped sections 4 (not shown in FIG. 6), whose height is higher than that of the truncated cone-shaped sections 3.

The amount of diameter reduction of the dome sections or the truncated cone-shaped sections in the first and the second steps are greater than that in the third step, so the ring marks are clearly formed in the first and the second steps.

To restrict forming the ring marks, in the present embodiment, the diameter of the first forming punches 70 is nearly equal to that of the bulging punches 55, and the diameter of the first forming dies 71 is nearly equal to that of the bulging punches 50. Further, in the shaping step section "b", the diameter of the forming dies and the forming punches of the following step is made shorter than that of the foregoing step with the diameter reduction rate of 0.8 or more, so that forming the ring marks can be effectively prevented.

When the third step is completed, the truncated cone-shaped sections 4 have enough height for forming the collars 7. Thus, in the pierce-burring step section "c", the through-holes 5 are bored in the truncated cone-shaped sections 4 by pierce punches 76 (see FIG. 1) and the collars 7 are formed by burring punches 78 (see FIG. 1). Finally, the flanges 6 are formed at upper ends of the collars 7 in the flaring step section "d". By forming the flanges 6, the collared-through-holes 17 are formed.

In the above described embodiment, the through-holes 5 and the collars 7 are simultaneously formed in the pierce-burring step section "c", then the flanges 6 are formed at the upper ends of the collars 7.

In another embodiment, the through-holes 5 and the collars 7 may be formed in separate steps.

Further, the collars 7, which have formed in the pierce-burring step section "c", may be further extended by ironing.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of manufacturing a heat exchanging fin having a plurality of collared-through-holes, comprising the steps of:

forming a plurality of dome sections, having diameters greater than inner diameters of the collared-through-holes and which are projected from one side face of a thin plate, and a plurality of circular recesses having diameters greater than said diameters of said dome sections, each of said circular recesses enclosing one of said dome sections, the circular recesses being depressed toward an opposite face of the thin plate;

forming said dome sections and said recesses into truncated cone-shaped sections having prescribed height in a plurality of steps;

forming a through-hole in each of said truncated cone-shaped sections;

forming edges of said through-holes into collars; and forming a flange at a front end of each of said collars.

2. The method according to claim 1, wherein the diameters of said dome sections are nearly equal to diameters of said truncated cone-shaped sections, which are formed in the first step.

3. A die set for manufacturing a heat exchanging fin, in which the heat exchanging fin is formed by the steps of forming a plurality of dome sections in a fin plate, forming the dome sections into truncated cone-shaped sections and forming the truncated cone-shaped sections into collared-through-holes, comprising:

a lower die including a bulging punch for forming the dome sections and a lifter being always biased upward by a biasing member and having a through-hole, through which the bulging punch passes when the lifter is moved downward;

an upper die relatively moving to and away from said lower die, said upper die including a bulging die, which has a die hole accommodating a front end section of the bulging punch when said upper die relatively moved to said lower die; and multiple pairs of forming die sets positioned one after another following said bulging die set in a direction of operation, wherein said bulging die has a projected section which is projected from an edge of the die hole toward said lower die, and wherein said lifter has a concave section which encloses the through-hole and which accommodates the projected section and forms a recess section having a diameter greater than a diameter of the dome section, the recess section enclosing the dome section and being depressed in the opposite direction of the projected direction of the dome section in the fin plate with the projected section when said upper die relatively moves to said lower die.

4. The die set according to claim 3, wherein a plurality of sets of said bulging punch and said bulging die are provided for forming the dome sections into the truncated cone-shaped sections in a plurality of steps, and wherein diameter of a forming punch and a forming die of the first step is nearly equal to that of said bulging punch and said bulging die.

* * * * *